US005459552A

United States Patent [19]

Ohira

[11] Patent Number: 5,459,552

[45] Date of Patent: Oct. 17, 1995

[54] IMAGE FORMING APPARATUS COMMUNICABLE WITH A CENTRALIZED CONTROL APPARATUS

[75] Inventor: Tadashi Ohira, Toyokawa, Japan

[73] Assignee: Minolta Camera Kabushiki Kaisha, Osaka, Japan

[21] Appl. No.: 105,687

[22] Filed: Aug. 13, 1993

[30] Foreign Application Priority Data

Aug. 19, 1992 [JP] Japan ..... 4-241450

[51] Int. Cl.[6] ..... G03G 21/00

[52] U.S. Cl. ..... 355/202; 355/204; 355/206

[58] Field of Search ..... 355/202, 204, 355/206, 208, 203, 207, 209, 205; 364/184, 185, 186; 379/106; 395/325

[56] References Cited

U.S. PATENT DOCUMENTS

| | | | |
|---|---|---|---|
| 4,314,334 | 2/1982 | Daughton et al. | 395/325 |
| 4,322,813 | 3/1982 | Howard et al. | 364/900 |
| 4,496,237 | 1/1985 | Schron . | |
| 4,497,037 | 1/1985 | Kato et al. | 364/900 |
| 4,550,382 | 10/1985 | Federico et al. | 364/572 |
| 4,583,834 | 4/1986 | Seko et al. . | |
| 4,737,907 | 4/1988 | Federico et al. | 364/200 |
| 4,739,366 | 4/1988 | Braswell et al. . | |
| 4,958,188 | 9/1990 | Miyamoto | 355/206 |
| 4,970,544 | 11/1990 | Furusawa et al. | 355/204 X |
| 4,999,672 | 3/1991 | Rice, Jr. et al. | 355/202 |
| 5,077,581 | 12/1991 | Suzuki | 355/200 |
| 5,077,582 | 12/1991 | Kravette et al. | 355/206 |
| 5,184,179 | 2/1993 | Tarr et al. | 355/207 |
| 5,216,461 | 6/1993 | Maekawa et al. | 355/202 |
| 5,347,346 | 9/1994 | Shimizu et al. | 355/202 |

FOREIGN PATENT DOCUMENTS 59-142559 8/1984 Japan .

OTHER PUBLICATIONS

Lynn S. Ritter, *Research Newsletter*, "Remote Diagnostics—Tool Kit of the Future", 1989, pp. 1–6.
"Research Newsletter" 1989–10; Dataquest; pp. 1–6.

*Primary Examiner*—A. T. Grimley
*Assistant Examiner*—Thu Dang
*Attorney, Agent, or Firm*—Burns, Doane, Swecker & Mathis

[57] ABSTRACT

An image forming apparatus communicable with a centralized control apparatus. When a trouble occurs in the image forming apparatus under predetermined transmission conditions where a communication terminal electrically connected to the centralized control apparatus through a communication network has been connected to the image informing apparatus, signals indicative of both the occurring trouble and other operational states of the image forming apparatus are transmitted to the centralized control apparatus. Further, information indicative of the fact that the signals have already been transmitted to the centralized control apparatus is displayed on a display area of a control panel. When a trouble occurs in the image forming apparatus where the communication terminal has been disconnected from the image forming apparatus, a method of effecting measures on the trouble is displayed on the display area of the control panel.

13 Claims, 7 Drawing Sheets

Fig. 5

| MESSAGE NUMBER | MESSAGE |
|---|---|
| 1 | WAIT |
| 2 | COPY AVAILABLE |
| 3 | SUPPLY COPY PAPER |
| 32 | OCCURRENCE OF TROUBLE, STATE OF TROUBLE IS BEING TRANSMITTED TO SERVICE STATION |
| 35 | OCCURRENCE OF TROUBLE, CALL SERVICE STATION TELEPHONE: xxx-xxxx |
| 36 | OCCURRENCE OF TROUBLE, STATE OF TROUBLE HAS BEEN INFORMED TO SERVICE STATION, REMOVE JAMMED PAPER |
| 37 | OCCURRENCE OF TROUBLE, STATE OF TROUBLE HAS BEEN INFORMED TO SERVICE STATION, REMOVE JAMMED ORIGINAL |
| 38 | OCCURRENCE OF TROUBLE, STATE OF TROUBLE HAS BEEN INFORMED TO SERVICE STATION, SUPPLY TONER |
| 39 | OCCURRENCE OF TROUBLE, STATE OF TROUBLE HAS BEEN INFORMED TO SERVICE STATION, WAIT ARRIVAL OF SERVICE MAN, SUPPLY TONER |
| 40 | PRESS RESET KEY |

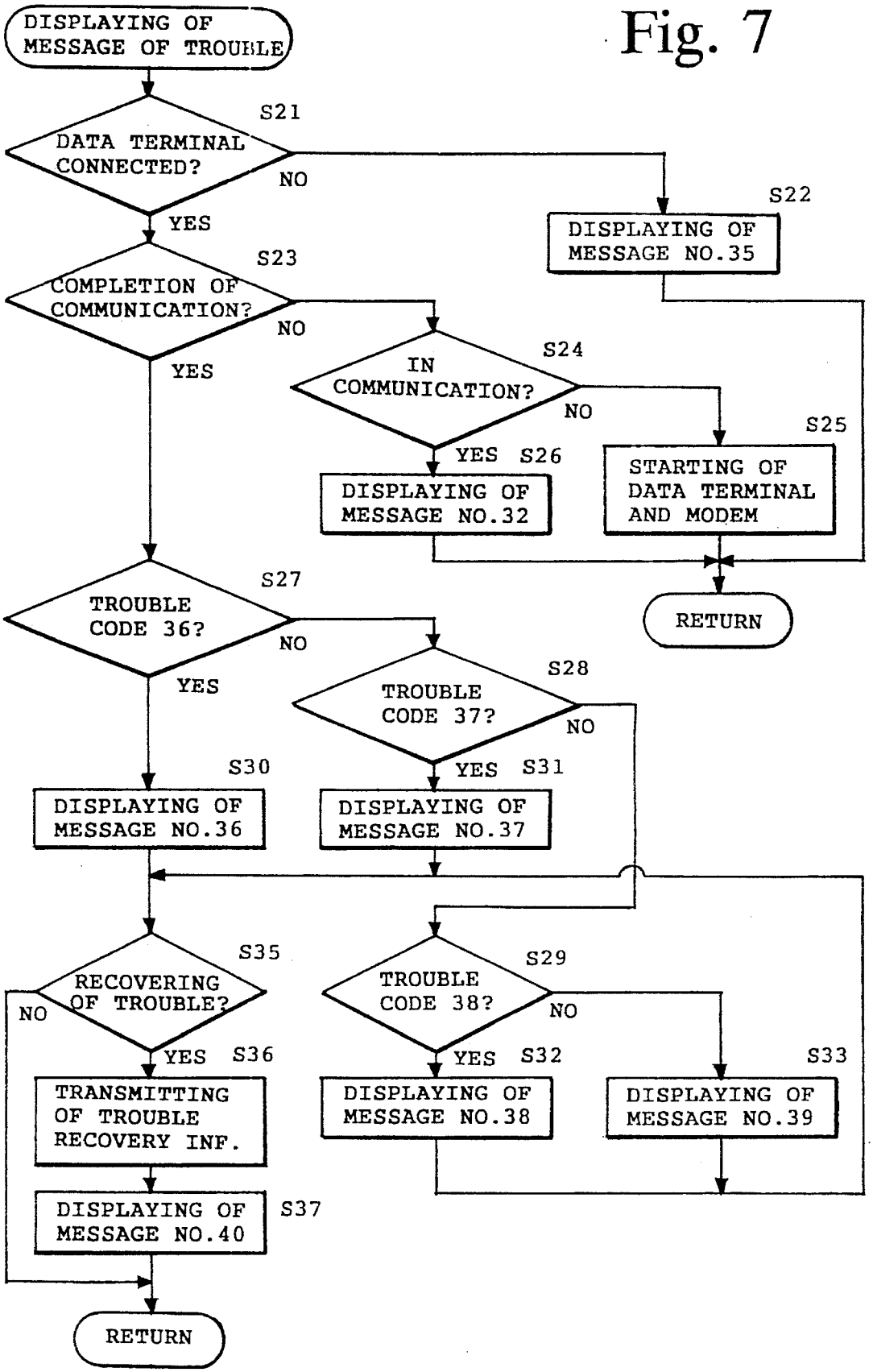
Fig. 7
DISPLAYING OF MESSAGE OF TROUBLE
S21
DATA TERMINAL CONNECTED?
NO
YES
S22
DISPLAYING OF MESSAGE NO.35
S23
COMPLETION OF COMMUNICATION?
NO
YES
S24
IN COMMUNICATION?
NO
YES
S26
DISPLAYING OF MESSAGE NO.32
S25
STARTING OF DATA TERMINAL AND MODEM
RETURN
S27
TROUBLE CODE 36?
NO
YES
S28
TROUBLE CODE 37?
NO
YES
S30
DISPLAYING OF MESSAGE NO.36
S31
DISPLAYING OF MESSAGE NO.37
S35
RECOVERING OF TROUBLE?
NO
YES
S36
TRANSMITTING OF TROUBLE RECOVERY INF.
DISPLAYING OF MESSAGE NO.40
S37
RETURN
S29
TROUBLE CODE 38?
NO
YES
S32
DISPLAYING OF MESSAGE NO.38
S33
DISPLAYING OF MESSAGE NO.39

IMAGE FORMING APPARATUS COMMUNICABLE WITH A CENTRALIZED CONTROL APPARATUS

BACKGROUND OF THE INVENTION

1. Field of the Invention

The present invention relates to an image forming apparatus connected to a remote centralized control apparatus through a communication line and controllable by the centralized control apparatus.

2. Description of the Related Arts

A system for controlling a plurality of copying machines has been disclosed in U.S. Pat. No. 4,583,834. In the disclosed system, various information about each copying machine, such as the total number of copied sheets, states of troubles, the residual number of sheets to be copied and the residual quantity of toner, etc. are transmitted to a computer. The computer electrically processes the transmitted information and feeds back instructions to the corresponding copying machines.

According to this type of system, a plurality of copying machines supplied to a user are electrically connected to a centralized control apparatus through a communication network such as a telephone line or the like thereby to make it possible to effect remote control for the copying machines. The centralized control apparatus is provided at the location where a controller in a service station exists. The controller allows the centralized control apparatus to receive therein information transmitted from each copying machine. Thus, control services such as the issuance of bills corresponding to the number of copies, the dispatch of a service man for responding to each trouble, etc. are executed.

However, even in the case of the copying machines connectable to the aforementioned control system, there are those which are used without being connected to the control system. When troubles occur in such copying machines, the user does not know what to do with troubles. Even in the case of simple troubles that the user can deal with, the user telephones the service station to make a repair request.

Simple troubles that the user can cope with, are sometimes included in the troubles occurring in each copying machine as in the case where originals conveyed by an original feeding device are jammed, copied sheets are jammed, toner is run out and copying sheets accommodated within a sheet feeding cassette are used up, for example. On the other hand, there is also a trouble such a type that when an exposure lamp has burnt out, for example, it is necessary for the service man to replace it with another.

Now, when the troubles occur in the copying machine connected to the control system, trouble data indicative of the states of the troubles are transmitted to the control apparatus in the service station from the copying machine. Thus, even if the user has recovered simple troubles such as the jamming of originals, etc. after the simple troubles has occurred, the service station decides without being informed of the recovery of the troubles that the copying machine still remains in troubled states. As a result, a problem occurs that the service man is dispatched to the user for repairing the troubled copying machine.

SUMMARY OF THE INVENTION

It is a principal object of the present invention to provide an image forming apparatus wherein when a trouble is detected in a state in which the image forming apparatus is being disconnected from a centralized control apparatus, a method of effecting measures on the detected trouble can be displayed, and when the trouble is detected in a state in which the image forming apparatus is being connected to the centralized control apparatus, the fact of transmission of data about the detected trouble to the centralized control apparatus can be displayed after completion of its transmission.

It is another object of the present invention to provide a system for controlling an image forming apparatus wherein when a trouble occurring in the image forming apparatus is detected in a state in which the image forming apparatus is being disconnected from a centralized control apparatus, trouble data indicative of the state of the detected trouble is displayed so as to provide a user with a visual representation, and when the trouble is detected in a state in which the image forming apparatus is being connected to the centralized control apparatus, the fact of transmission of data about the detected trouble to the centralized control apparatus is displayed so as to provide a user with a visual representation after completion of its transmission.

The above and other objects, features and advantages of the present invention will become apparent from the following detailed description and the appended claims, taken in conjunction with the accompanying drawings in which a preferred embodiment of the present invention is shown by way of illustrative example.

BRIEF DESCRIPTION OF THE DRAWINGS

FIG. 5 is a view for describing one example of messages displayed on the control panel;

FIG. 7 is a flowchart for describing a message displaying process executed upon occurrence of troubles.

DETAILED DESCRIPTION OF THE PREFERRED EMBODIMENTS

A preferred embodiment of the present invention will hereinafter be described in detail with reference to the accompanying drawings.

[System for controlling copying machine]

Figure 1:
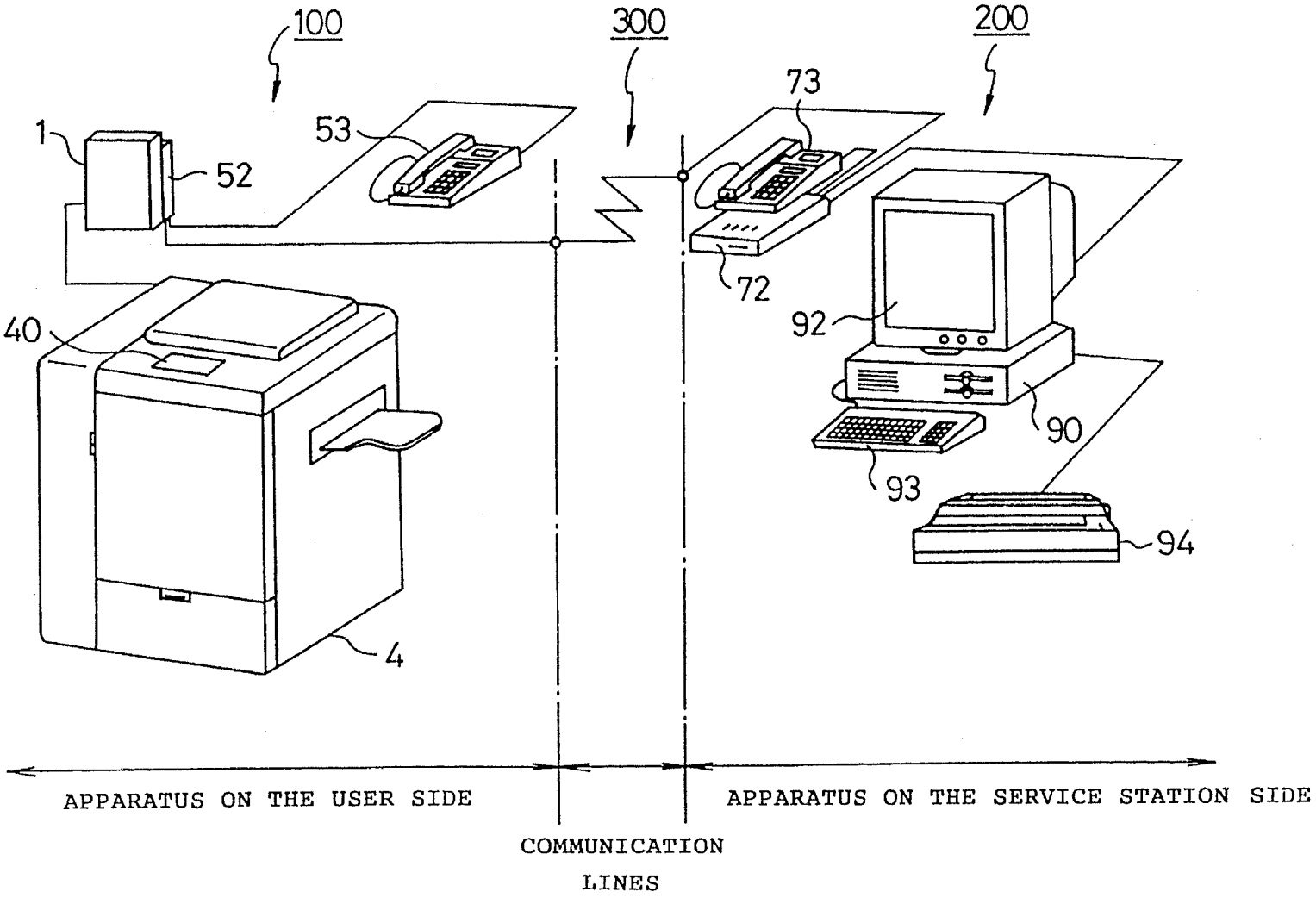
FIG. 1 is a schematic view showing the structure of a system for controlling a copying machine.

The structure of a system for controlling a copying machine will now be described below. FIG. 1 is a schematic view for explaining the structure of the copying machine control system. In the same drawing, reference numeral 100 indicates an apparatus on the user side, which is shown as comprising a copying machine 4, a data terminal 1, a modem 52 having a function which serves as a communication terminal, and a telephone set 53. Further, reference numeral 200 indicates a control apparatus provided on the service station side, which is shown as comprising a modem 72 having a function which serves as a communication terminal, a telephone set 73, and a computer 90 electrically connected with a display 92, a keyboard 93 and a printer 94. A plurality of apparatuses 100 are actually used although only one shown in the preset embodiment. The apparatuses are electrically connected to the control apparatus 200 provided on the service station through communication lines 300.

The data terminal 1 receives therein various signals indicative of the states of operations and troubles of the copying machine 4 connected thereto thereby to effect predetermined processes so as to file or compile control data. Further, the data terminal 1 transmits the control data to the control apparatus 200 installed in the service station through the corresponding communication line 300. Incidentally, the transmission of the data to the control apparatus 200 is effected on occasion when the trouble takes place as well as in the case of the predetermined period (fixed time).

Further, the computer 90 of the control apparatus 200 controls a corresponding copying machine 4 based on the control data transmitted from the data terminal 1. That is, when, for example, trouble information is sent from the data terminal 1 as the control data, the computer 90 calculates the time when a service man is to be sent to a user and transmits it to the data terminal 1. Further, the computer 90 produces data about instructions given to the service man, for example, data indicative of a user's name and an identification number of a troubled copying machine, the state of its trouble, etc.

[Copying machine]

Since the copying machine 4 is of a known electrophotographic copying machine, a description regarding the structure of an image forming mechanism will be omitted herein. This type of copying machine has various mechanisms related to the formation of an image, which are provided with sensors each used to detect the state of operation of each mechanism. As these sensors, may be included those for sensing an electric potential on the surface of a drum coated with photosensitive materials, the amount of toner in a developer, the amount of exposure of the drum, a developing bias voltage, the amount of toner adhering onto the drum, a grid voltage of a charger, etc. In order to sense the states of troubles or failures of the various mechanisms related to the formation of the image, trouble sensors are provided to their corresponding mechanisms. Such trouble sensors may include a sensor for sensing undesired states such as a burning-out of an exposure lamp, a burning-out of a fixing heater, an undesired discharge of a charge wire, etc., a sensor for detecting the jamming of copying paper traveling on a conveying path, a sensor for detecting whether or not the jammed copying paper has been removed, etc.

Figure 2:
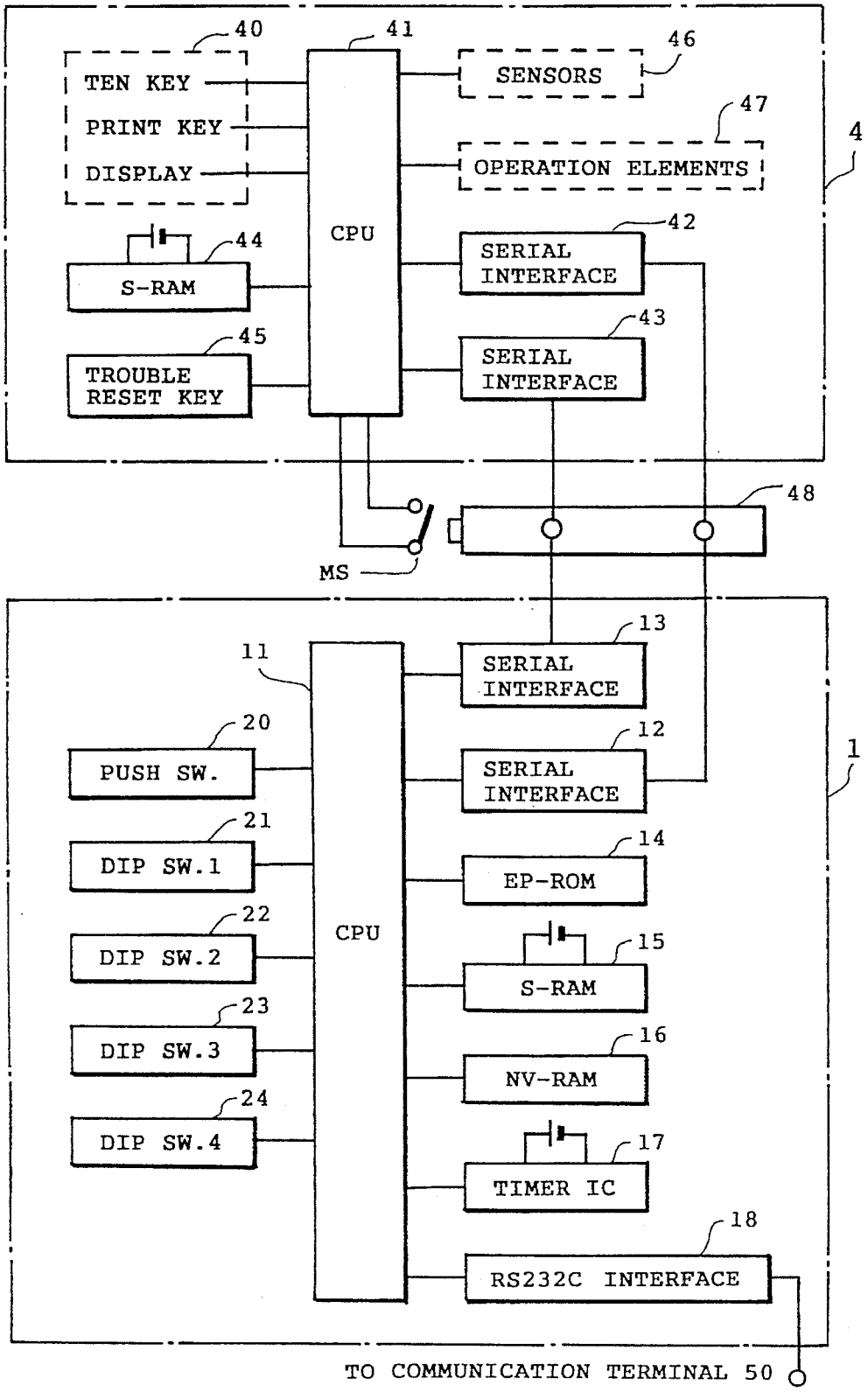
FIG. 2 is a circuit block diagram showing both a control circuit of a copying machine and a data terminal.

FIG. 2 is a block circuit diagram showing a control circuit of the copying machine 4 and a circuit of the data terminal 1. Signals indicative of the states of operations and troubles of the respective mechanisms, which have been detected by the various sensors provided in the copying machine 4, are electrically processed by the CPU 41 of the copying machine 4, and thereafter converted into a serial signal, which is in turn outputted to the data terminal 1 through serial interfaces 43 and 13 in that order.

Then, a count indicative of the number of copying sheets by a total counter, which is used to calculate charges required to use the copying machine, a count obtained by a paper size counter, which is indicative of the number of sheets to be used in every paper sizes, a count obtained by jam counter, which is indicative of the frequency of jammings occurring in paper feeding path contributing to a measure or criterion of maintenance, a count obtained by a trouble counter, which is indicative of the frequency of troubles occurring in various elements, and a count obtained by an element availability counter, which is indicative of the number of times at which the respective elements are used, are processed by the CPU 41 of the copying machine. Thereafter, the so-processed counts are converted into serial signals, which are in turn outputted to the data terminal 1 through serial interfaces 42 and 12 in that order.

Figure 4:
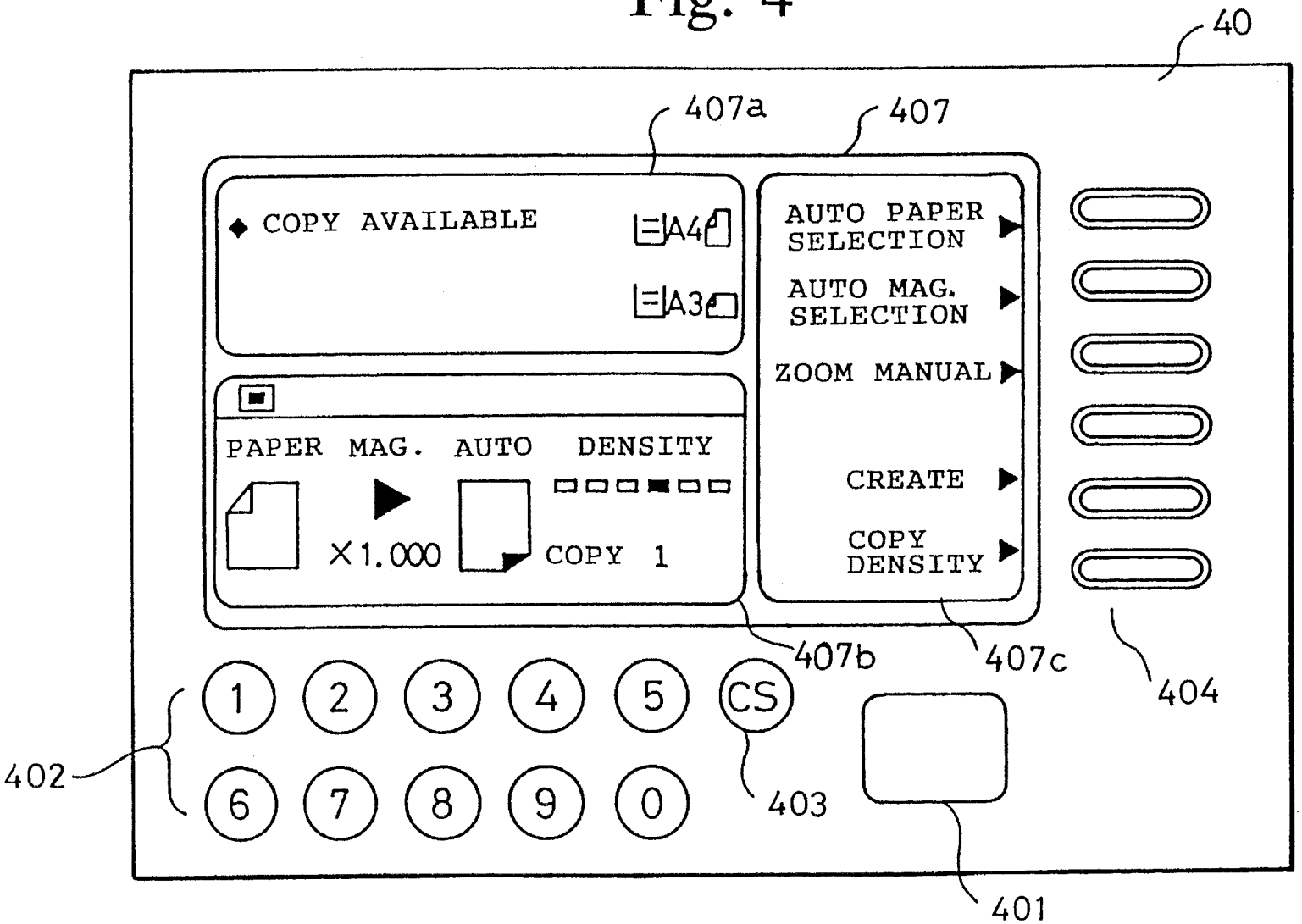
FIG. 4 is a plan view illustrating a control panel of the copying machine.

Inputted to the CPU 41 in the copying machine 4 are signals sent from various keys mounted on a control panel 40 shown in FIG. 4, such as a print key 401 for giving instructions about the initiation of a copying operation, a numerical input ten key set 402, a clear/stop key 403 for clearing an input numerical value and stopping the copying operation, a function key 404, etc., and signals supplied from a trouble reset key 45 provided externally from the control panel 40. Corresponding operations and modes are set up based on these input signals respectively.

The CPU 41 in the copying machine 4 outputs a signal for driving or activating a graphic display panel 407 mounted on the control panel 40. The graphic display panel 407 includes a message block **407*a* for displaying thereon various states of the copying machine 4 such as the state of a failure to copy, the state of copying sheets being empty in a sheet-feeding cassette, the state of toner being empty, etc., a copying mode block 407*b* for displaying thereon copying conditions such as the states of setting of the number of sheets to be copied, the size of paper, the density of image to be produced, copying magnification, creation and the like, and a multifunction block 407*c* for setting up automatic paper selection, automatic magnification selection, zoom magnification, creation, copying density, etc. under an interactive mode in accordance with operations combined with the function key 404**.

Various messages shown in FIG. 5 to be described later are displayed on the message block **407*a* according to the state of the copying machine 4. After the trouble has occurred, corresponding messages shown in FIG. 5, which are subsequent to one indicated by a display code 32, are successively displayed on the message block 407*a* according to the condition of communication of the modem 52 activated by the data terminal 1**.

A RAM 44 electrically connected to the CPU 41 in the copying machine stores the type name and serial number of the copying machine 4 therein as data upon delivery of the copying machine 4 from its factory. When the copying machine 4 is installed in a user's office, the type name and the serial number are stored and registered in a RAM electrically connected to a CPU 91 of the control apparatus 200 according to a transmit request issued from the control apparatus 200 in the service station. In addition to the above, data about the messages shown in FIG. 5 are stored in the RAM 44 electrically connected to the CPU 41 in the copying machine 4.

[Data terminal]

The data terminal 1 receives and processes various signals indicative of the states of the copying machine 4, which are outputted from the CPU 41 in the copying machine 4 connected thereto. Further, the data terminal 1 edits control data based on the result of processing. When predetermined transmission conditions to be described later are met, the data terminal 1 activates the modem 52 so as to be connected with the control apparatus 200 in the service station through the corresponding communication line. Thereafter, the data terminal 1 serves to transmit the edited control data in the copying machine 4 to the CPU 91 of the control apparatus 200 (see FIG. 1).

As is apparent from FIG. 2, the CPU 11 of the data terminal 1 is electrically connected with a ROM 14 having control programs stored therein, a non-volatile memory 16 having number data or the like stored therein, a working RAM 15 which is to be backed up by a battery, a timer IC 17 which is to be backed up by a battery, etc. The CPU 11 is also electrically connected to the CPU 41 through the serial interfaces 12 and 42 and the serial interfaces 13 and 43. Thus, the data transmitted from the CPU 41 is also inputted to the CPU 11, where it is electrically processed. This processing will be described later.

As shown in FIG. 2, the CPU 11 of the data terminal 1 is electrically connected with a push switch 20 and dip switches 21 through 24. The push switch 20 is activated so as to give instructions for the initialization transmission or manual transmission. The dip switch 21 is activated so as to set up an input mode corresponding to a selection number (telephone number) of the service station. The dip switch 22 is activated so as to set up an input mode corresponding to an identification number (DTID) of the data terminal 1. The dip switch 23 is activated so as to set up an input mode corresponding to an identification number (STID) of the service station. Further, the dip switch 24 is used to set up an initialization mode.

Incidentally, the copying machine 4 and the data terminal 1 are electrically connected to each other through a connector 48. In this case, a microswitch MS for detecting the state of connection between the two is attached to a connecting portion therebetween. The data terminal 1 can decide based on the state of the microswitch MS whether or not the copying machine 4 is being connected to the data terminal 1.

Figure 3:
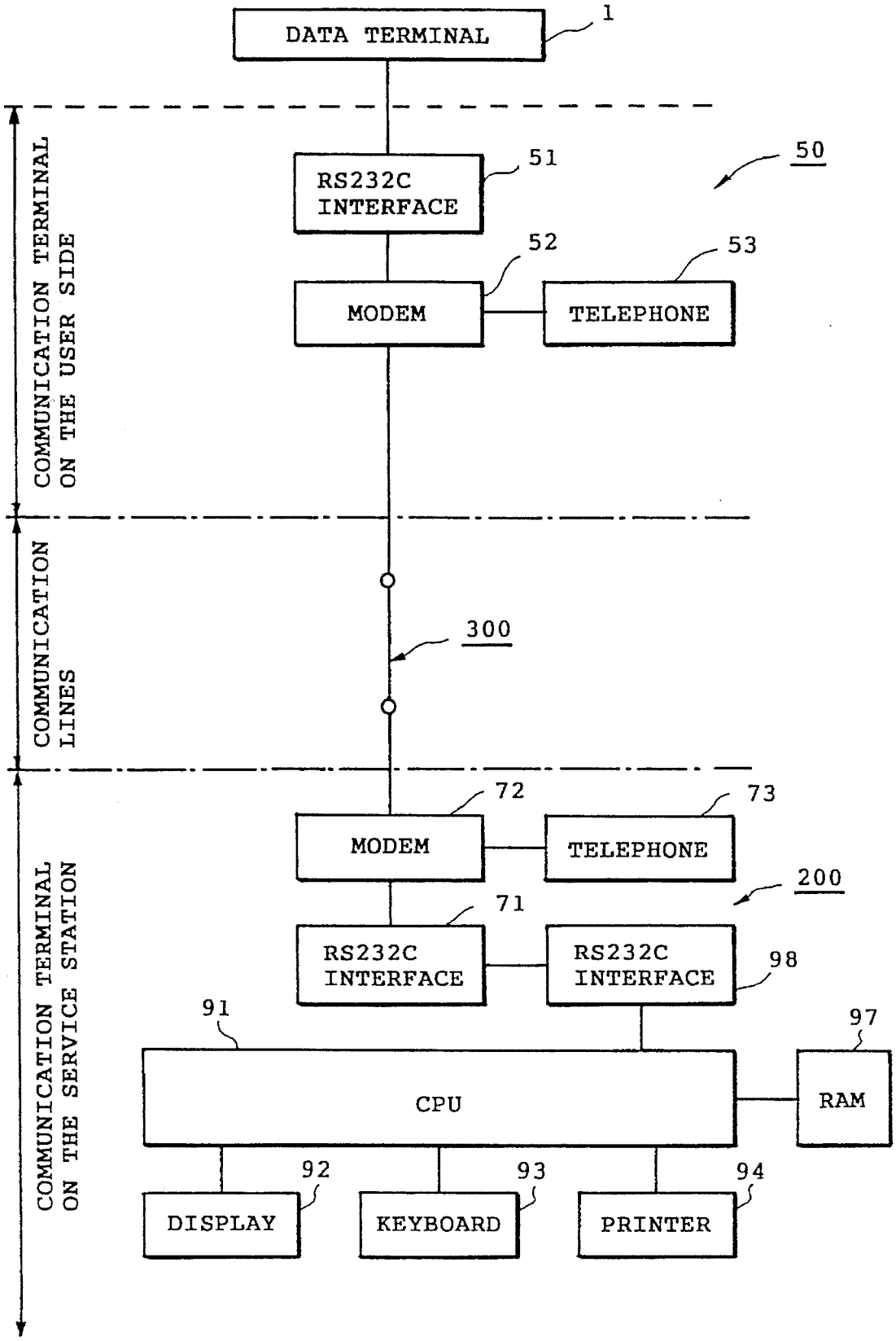
FIG. 3 is a circuit diagram showing the electrical connection between the data terminal and a control apparatus.

FIG. 3 is a circuit diagram showing the electrical connection between the data terminal 1 and the control apparatus 200 in the service station. The data terminal 1 is electrically connected to the modem 52 serving as the communication terminal through both a communication interface (RS232C) 18 incorporated in the data terminal 1 and a communication interface (RS232C) 51 in a communication terminal 50 on the user side, and the data terminal 1 is electrically connected to the modem 72 of the control apparatus 200 in the service station.

Upon installation of the copying machine 4, the control data transmitted from the CPU 11 of the data terminal 1 to the CPU 91 of the control apparatus 200 represent the identification data (DTID) about the name of type of the copying machine 4, the serial number thereof and the like, which is used as an initially-set value. Further, data transmitted at the fixed period represents control data indicative of the state of the copying machine 4. Upon occurrence of trouble, the control data represents trouble data indicative of the kind of each trouble.

[Control apparatus]

As shown in FIG. 3, the control apparatus 200 in the service station is of a computer system including the CPU 91 and peripheral device. The modem 72 having the function serving as the communication terminal is electrically connected to the CPU 91 through a communication interface (RS232C) 71 and a communication interface (RS232C) 98 of the CPU 91. A plurality of copying machines supplied to a number of users are electrically connected to the control apparatus 200 in the service station through their corresponding data terminals and controlled by the control apparatus 200.

Control files for respective copying machines are compiled so as to be loaded into a RAM 97 connected to the CPU 91, based on the identification data about the names of types of copying machines, the serial numbers thereof and the like all of which have been inputted as the initialized values upon installation of the respective copying machines. Then, the contents of the files are updated based on subsequently-inputted control data. At the end of the month, the contents of the files are read out to calculate charges. Further, bills are printed based on the calculated charges. The next time data to be transmitted on time and the next update password are sent to the corresponding data terminal when the fixed-time communication is made. When the communication at the time of occurrence of the trouble is made, the scheduled time for call of the service man is calculated and decided and then transmitted to the corresponding data terminal. On the other hand, instructions such as the date and time for call, the state of each trouble, tools to be taken with the service man, parts, etc., which are given to the service man, are printed.

FIG. 5 shows one example of messages displayed on the message block of the control panel. One of the messages is selected depending on the state of operation of each copying machine and the state of each copying machine at the time of its selection is displayed on the message block. When the trouble takes place, a message for giving instructions for coping with the trouble is displayed according to a decision made as to whether the copying machine is being connected to its corresponding data terminal and the condition of communication between the data terminal and the service station both connected to each other through the activated modem 52.

[Processes by the CPU 41]

Processes executed by the CPU 41 of the copying machine 4 will now be described with reference. to flowcharts shown in FIGS. 6 and 7.

Figure 6:
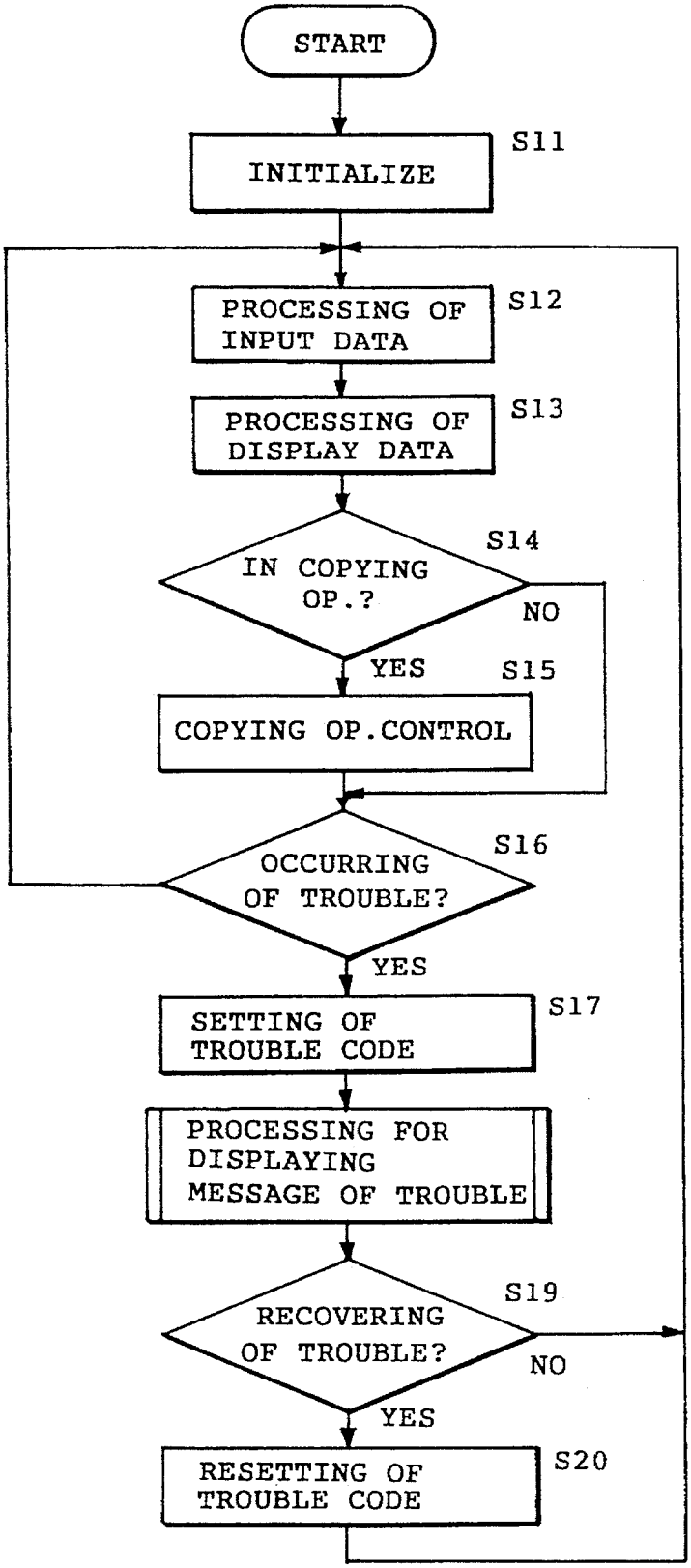
FIG. 6 is a flowchart for describing the summary of processes executed by a CPU of the copying machine.

FIG. 6 is a flowchart for describing the outline of the process executed by the CPU 41. A program is first operated when a power source is turned on. Then, the initialization such as the clearing of a memory, the setting of a standard mode, etc. is effected (Step S11).

In Step S12, a process for receiving various input signals such as input signals supplied from various switches and various sensors such as a trouble sensor, etc., all of which have been disposed inside the copying machine, key switches provided on the control panel 40, and an input signal supplied from the CPU 11, is executed. In Step S13, a process for displaying information indicative of various states on the control panel 40 is executed. Incidentally, a process for displaying a message on the message block is executed to display various data related to copying operation other than data at the time of occurrence of a trouble.

It is decided whether or not the copying machine 4 is in copying operation (Step S14). If the answer is YES in Step S14, then processes necessary for copying operation, i.e., control of various operating elements, such as paper feeding control, scanning control, control for the photosensitive drum, control for a developing unit are executed (Step S15).

It is then decided based on signals outputted from the sensors in the copying machine whether or not troubles such as the occurrence of paper jamming, the burning out of the exposure lamp and the fixing heater, improper discharge of the charge wire, etc. have occurred (Step S16). If the answer is YES in Step S16, then a trouble code corresponding to the kind of trouble is set to the CPU 11 of the data terminal 1 and a trouble signal is produced (Step S17). Thereafter, a process for displaying a message indicative of the occurrence of the trouble is executed (Step S18). When the CPU 11 of the data terminal 1 receives the trouble signal therein, it outputs the same to the service station.

It is next determined whether or not the trouble has been recovered (Step S19). If the answer is YES in Step S19, then the trouble code is reset (Step S20) and the routine is returned to Step S12. If the answer is NO in Step S16 or the answer is NO in Step S19, then the routine is returned to Step S12.

The message displaying process executed in Step S18 at the time of the occurrence of the trouble will next be described in detail with reference to the flowchart shown in FIG. 7.

It is first decided based on the state of the microswitch MS (see FIG. 2) whether or not the data terminal 1 has been connected to the copying machine (Step S21). If the answer is NO in Step S21, then the routine proceeds to Step S22, where a message number 35 shown in FIG. 5 is displayed. Now, consider that the telephone number in the message number 35 has been set up in advance by the service man upon installation of the copying machine. At this time, a method of effecting a process or measures corresponding to the kind of trouble is displayed, thereby making it possible to call attention to user's measures against the trouble.

If the answer is YES in Step S21, then messages displayed depending on the condition of communication between the service station and the data terminal 1 and the state of the trouble are selected in the following manner.

It is first decided whether the communication between the data terminal 1 and the service station has been made (Steps S23 and S24). If the answer is NO in Steps S23 and S24, then the data terminal 1 and the modem 52 are started and a process for connecting between the data terminal 1 and the service station through the communication line is executed (Step S25). If it is decided that the data terminal 1 and the service station are connected to each other through the communication line and they are in communication, then a message number 32 shown in FIG. 5 is displayed (Step S26). If it is decided in Step S23 that the communication with the service station has been made, then the routine proceeds to Steps subsequent to Step S27, and the following message displaying processes are executed.

It is decided in Steps S27, S28 and S29 whether or not the trouble code (which has been set up in Step S17 of FIG. 6) exists. If it is decided that the trouble code is 36 and shows the jamming of copying paper, then a message number 36 shown in FIG. 5 is displayed (Step S30). If it is decided that the trouble code is 37 and shows the jamming of originals, then a message number 37 is displayed (Step S31). If it is decided that the trouble code is 38 and shows the state of toner being empty, then a message number 38 is displayed (Step S32). The troubles indicated by the aforementioned trouble codes can be recovered by the user of the copying machine. Therefore, methods of effecting processes or measures corresponding to the kinds of troubles are displayed, thus making it possible to urge the user to take measures against the troubles.

If it is decided that the trouble code is 39 and shows other unwanted troubles such as the burning out of the exposure lamp and the fixing heater, the improper discharge of the charge wire, etc., then a message number 39 is displayed (Step S33). Such troubles displayed by the trouble code 39 are of those which need, for example, the replacement of elements with others and the repairing of a copying machine by the service man.

Then, the routine proceeds to Step S35, where it is decided whether the trouble has been brought back to normal condition by the recovery operation of the user of the copying machine or by the repairing of the copying machine by the service man (Step S35). If the answer is YES in Step S35, then information indicative of the recovery of the trouble is transmitted to the service station through the data terminal 1 and the corresponding modem and communication line (Step S36). Further, a message number 40 is displayed on the display panel (Step S37) and an instruction for pushing a trouble reset key 45 is issued.

According to the present invention, as has been described above, when each trouble occurring in an image forming apparatus is detected, a communication terminal means is activated to execute a process for connecting a communication line with a centralized control apparatus in a control center. If it is, however, decided at this time that the communication terminal means is being disconnected from the image forming apparatus, then, a method of effecting measures on the detected trouble is displayed on a display means to give a recovery instruction to a user. Therefore, the user can rapidly cope with a simple trouble. If it is decided that the communication terminal means is being connected with the image forming apparatus, then a message indicative of the fact that data about the detected trouble is being transmitted to the centralized control apparatus, is displayed on the display means. Thus, the user can be informed of the fact that a service man makes a call for repairing and checking. When the user effects a process or measure on each trouble occurring in the image forming apparatus and hence the trouble has been recovered, a signal indicative of the fact of recovery of the trouble is transmitted to the centralized control apparatus. It is therefore possible to avoid idle repairing and checking movements that the service man calls on the user without being informed of the fact that the trouble has already been recovered.

Having now fully described the invention, it will be apparent to those skilled in the art that many changes and modifications can be made without departing from the spirit or scope of the invention as set forth herein.

What is claimed is:

1. An image forming apparatus controllable by a remote centralized control apparatus through a communication network, comprising:

communication terminal means connectable to said image forming apparatus and connected to said centralized control apparatus through said communication network;

first detecting means for detecting states in said image forming apparatus;

transmitting means for transmitting data related to said detected states to said centralized control apparatus when predetermined transmission conditions are met and when said communication terminal means has been connected to said image forming apparatus;

memory means for storing therein a plurality of messages associated with said detected states and indicative of methods for effecting said detected states in said image forming apparatus;

display means for displaying said messages thereon;

second detecting means for detecting whether said communication terminal means is connected to said image forming apparatus; and controlling means for controlling said display means in response to said detected states when said communication terminal means is disconnected from said image forming apparatus, in such a manner that messages stored in said memory means and corresponding to said detected states are read and displayed on said display means, and for controlling said display means when said communication terminal means is connected to said image forming apparatus, in such a manner that a message indicative of the fact that the data about said detected states are being transmitted to said centralized control apparatus, are displayed on said display means.

2. An image forming apparatus according to claim 1, wherein said predetermined transmission conditions include the occurrence of troubles.

3. An image forming apparatus according to claim 2, wherein said first detecting means detects troubles occurring in said image forming apparatus.

4. An image forming apparatus according to claim 3, further comprising:

deciding means for deciding that the detected troubles have been recovered; and wherein when it is decided that the troubles have been recovered, said transmitting means transmits the fact of recovery of the troubles to said centralized control apparatus.

5. An image forming apparatus controllable by a remote centralized control apparatus through a communication network, comprising:

communication terminal means connectable to said image forming apparatus and connected to said centralized control apparatus through said communication network;

first detecting means for detecting states in said image forming apparatus;

transmitting means for transmitting data related to said detected states to said centralized control apparatus when predetermined transmission conditions are met and when said communication terminal means has been connected to said image forming apparatus;

memory means for storing therein a plurality of messages associated with said detected states and indicative of methods for effecting said detected states in said image forming apparatus;

display means for displaying said messages thereon;

second detecting means for detecting whether said communication terminal means is connected to said image forming apparatus; and controlling means for controlling said display means in response to said detected states when said communication terminal means is disconnected from said image forming apparatus, in such a manner that messages stored in said memory means and corresponding to said detected states are read and displayed on said display means, and for controlling said display means when said communication terminal means is connected to said image forming apparatus, in such a manner that a message indicative of the fact that the data about said detected states have been transmitted to said centralized control apparatus, are displayed on said display means after the completion of their transmission.

6. An image forming apparatus according to claim 5, wherein said predetermined transmission conditions include the occurrence of troubles.

7. An image forming apparatus according to claim 6, wherein said first detecting means detects troubles occurring in said image forming apparatus.

8. A method effected by an image forming apparatus which has a communication terminal connected via a communication network to a remote centralized control apparatus and is controllable by said centralized control apparatus, said method comprising the steps of:

detecting troubles occurring in said image forming apparatus;

detecting whether said communication terminal is connected to said image forming apparatus;

displaying methods for correcting said detected troubles when said communication terminal is disconnected from said image forming apparatus; and displaying, when said communication terminal is connected to said image forming apparatus, a message indicative of the fact that data related to said detected troubles are being transmitted to said centralized control apparatus.

9. A method according to claim 8, further comprising the steps of:

deciding that said detected troubles have been recovered; and transmitting the fact of recovery of the troubles to said centralized control apparatus when it is decided that the troubles have been recovered.

10. A method executed by an image forming apparatus which has a communication terminal means connected via a communication network to a remote centralized control apparatus and is controllable by said centralized control apparatus, said method comprising the steps of:

detecting troubles occurring in said image forming apparatus;

detecting whether said communication terminal means is being connected to said image forming apparatus;

displaying methods of effecting measures on said detected troubles when said communication terminal means is being disconnected from said image forming apparatus;

transmitting data about said detected troubles to said centralized control apparatus when said communication terminal means is being connected to said image forming apparatus; and displaying the fact of transmission of the data about troubles after the completion of the transmission.

11. A system for controlling an image forming apparatus, comprising:

at least one data terminal connectable to said image forming apparatus so as to collect data from said image forming apparatus;

a centralized control apparatus connected to said data terminal through a communication network so as to receive therein data transmitted from said data terminal through said communication network;

display means for displaying messages thereon;

first detecting means for detecting whether said data terminal is being connected to said image forming apparatus;

second detecting means for detecting the occurrence of troubles in said image forming apparatus;

memory means for storing therein a plurality of messages indicative of methods of effecting measures on the troubles occurring in said image forming apparatus; and selecting means for selecting one message to be displayed on said display means from messages stored in said memory means in response to a detected trouble when said data terminal is being disconnected from said image informing apparatus.

12. A system according to claim 11, wherein said display means includes an indicator provided on a control panel of said image forming apparatus.

13. A system for controlling an image forming apparatus, comprising:

at least one data terminal connectable to said image forming apparatus so as to collect data from said image forming apparatus;

a centralized control apparatus connected to said data terminal through a communication network so as to receive therein data transmitted from said data terminal through said communication network;

first detecting means for detecting troubles occurring in said image forming apparatus;

second detecting means for detecting whether said data terminal is being connected to said image forming apparatus;

display means for displaying thereon a message in response to the detection of each trouble; and controlling means for controlling said display means so as to change a displaying method to another upon detection of the trouble depending on whether said data terminal is being connected to or disconnected from said image informing apparatus.

* * * * *